US005329669A

United States Patent [19]

Jamerson

[11] Patent Number: 5,329,669

[45] Date of Patent: Jul. 19, 1994

[54] DRIVE SYSTEM FOR CARDING MACHINE DOFFER, CRUSH AND CALENDAR ROLLS

[76] Inventor: Doug L. Jamerson, 300 Claxton Dr., Greenville, S.C. 29611

[21] Appl. No.: 845,145

[22] Filed: Mar. 3, 1992

Related U.S. Application Data

[63] Continuation-in-part of Ser. No. 739,220, Aug. 1, 1991, abandoned.

[51] Int. Cl.[5] ..... D01G 15/36

[52] U.S. Cl. ..... 19/98; 19/106 R

[58] Field of Search ..... 19/98, 99, 100, 105, 19/106 R, 108, 109, 112, 150

[56] References Cited

U.S. PATENT DOCUMENTS

| | | | |
|---|---|---|---|
| 373,137 | 11/1887 | George | 19/106 R |
| 403,721 | 5/1889 | Ashworth | 19/106 R |
| 1,737,435 | 11/1929 | Schofield | 19/99 |
| 2,795,012 | 6/1957 | Gibson et al. | 19/98 |
| 3,100,914 | 8/1963 | Milnes | 19/109 |
| 3,214,898 | 11/1965 | Royster | 19/98 |
| 3,308,511 | 3/1967 | Culpan | 19/98 |
| 3,999,249 | 12/1976 | Katoh et al. | 19/98 X |
| 4,320,560 | 3/1982 | Beneke et al. | 19/98 |
| 4,831,691 | 5/1989 | Hollingsworth et al. | 19/98 |

*Primary Examiner*—Clifford D. Crowder
*Assistant Examiner*—Ismael Izaguirre

[57] ABSTRACT

A fiber processing system for the front end of a textile card, the system having a doffer, a crush roll pair and a calendar roll pair rotatably mounted in progression respectively from back to front on the front end of the frame of the card, a gear on the doffer, a timing pulley-gear combination or unit rotatably mounted on the frame and having its gear engaging the gear on the doffer for either driving the same or being driven thereby, a drive motor drivingly connected to either the doffer or the timing pulley-gear combination for driving the system, a driven timing pulley on each of the roll pairs, and a timing belt system connecting the timing pulley of the timing unit to each of the driven timing pulleys of the roll pairs for rotating the same at speeds proportional to the speed of rotation of the doffer, and the roll pairs including gear means on the other ends of each roll for causing the rolls to rotate in tandem.

6 Claims, 4 Drawing Sheets

DRIVE SYSTEM FOR CARDING MACHINE DOFFER, CRUSH AND CALENDAR ROLLS

CROSS REFERENCE TO RELATED APPLICATION

This application is a continuation-in-part of Applicants now abandoned application Ser. No. 07/739,220 filed Aug. 8, 1991 of same title, the invention concerning textile card machines, hereinafter denoted "card", and especially the fiber processing section thereof which is located at the front end of the machine, i.e., the portion downstream of the main card cylinder.

BACKGROUND OF THE INVENTION

1. Field of The Invention

The invention particularly concerns a novel, highly efficient and practical drive mechanism for the front end processing cylinders, roll pairs and the like of the card.

2. Background Information

In a typical card, a web or lap is processed in a carding operation to produce a sliver for subsequent processing into textile yarn. The lap is generally in the form of a web of textile material wound on a lap pin which is supported on the card for unwinding and feeding to a main cylinder where it is carded. The textile material is removed from the carding cylinder by a doffer cylinder which rotates closely adjacent the carding cylinder on the end opposite the lap roll. The doffer cylinder is normally driven by a take-off from the main drive of the carding cylinder through a production gear. The production gear is engaged and disengaged with a ring gear mounted on the shaft of the doffer cylinder by means of raising and lowering a drop lever on which the production gear is carried. Other drive arrangements are also utilized. The lap roll is normally driven by a take-off from the doffer cylinder. The web of textile material removed by the doffer cylinder is subsequently drawn therefrom and progressively passed through crush-rolls and calendar-rolls and condensed into a sliver which is deposited into a coiler can for transportation and further processing. It is important that a uniform weight and quality of sliver be deposited in the coiling can.

3. Discussion Of Prior Art

The front end of the card typically comprises the doffer cylinder, crush-rolls and calendar-rolls which are usually driven separately from the carding cylinder and which are drivingly interconnected by a complex series of gears, sprockets and chains as shown in U.S. Pat. Nos. 3,965,401 and 4,027,358, the disclosures of which relating to the general structure and operation of cards are incorporated herein by reference.

Such prior, near solid hook-up driving mechanisms between the doffer, crush-rolls and calendar-rolls requires, of course, nearly constant lubrication and wear maintenance, and is quite costly to repair or replace. Also, the speeds with which the crush-rolls and calendar-rolls may be run through such a near solid drive device are limited, due in part to the non-uniformity of fiber web thickness and weight issuing from the front end as a result of the almost imperceptible rotational speed irregularities inherent in such drive devices. For example, the doffer of a typical card having such near solid drive construction should not be run faster than about 22 revolutions per minute to process 30–33 pounds of fiber per hour into a 55–60 grain silver, otherwise, marked irregularities in texture, composition or weight of the silver can occur.

Objects therefore, of the present invention are: to provide a drive mechanism for the fiber processing system of the front end of a textile card which minimizes maintenance and cost thereof and which allows substantially higher operating speeds and silver output of the card without sacrificing product quality; to reduce the number and structural complexity of the drive mechanism components; and to provide such a mechanism which can be installed on practically any conventional card with a minimum of alteration thereof.

BRIEF DESCRIPTION OF THE INVENTION

These and other objects hereinafter appearing have been attained in accordance with the present invention which is defined in its broad sense as a fiber processing system for the front end of a textile card, comprising doffer cylinder, crush roll pair and calendar-roll pair rotatively mounted in progression respectively from back to front on the front end of frame means of the textile card, a gearing means on said doffer cylinder, a timing unit having a timing drive pulley and timing gear combination rotatably mounted on said frame means for tandem rotation, said timing gear of said timing unit engaging said gearing means on said doffer cylinder means, drive means including speed reduction means, for directly driving said doffer cylinder a timing slave pulley on one end of one roll of each of said crush roll pair and calendar-roll pair, at least one timing belt connecting said timing drive pulley to each of said timing slave pulleys of said pair and calendar-roll pair for rotating each said pair at speeds proportional to the speed of rotation of said doffer cylinder, and meshing gear means on the opposite end of each said one roll and on the adjacent end of each other roll of each said pair for causing the two rolls of each said pair to rotate in tandem.

In certain preferred embodiments:

(a) a separate dual compound timing pulley is mounted on said frame means, and the driven timing pulley means of both said roll means are connected to the same pulley of said dual timing pulley;

(b) each of said gear means and pulley means is dimensioned such that the surface speeds of said doffing cylinder means and said crush-roll means are substantially equal, and the surface speed of said calendar-roll means is up to about 40% faster than the surface speed of said crush-roll means;

(c) the rotational axis of each of said roll means and of said timing unit, i.e., timing pulley and gear are substantially on a line segment, and the rotational axis of said dual timing pulley is generally vertexly oriented with respect to said line segment; and (d) the rotational axis of each driven timing pulley means of said crush-roll and calendar-roll means, and the timing pulley means of said timing unit are substantially in alignment.

BRIEF DESCRIPTION OF THE DRAWINGS

The invention will be further understood from the following drawings and description thereof, wherein.

DESCRIPTION OF THE PREFERRED EMBODIMENTS

Figure 1:
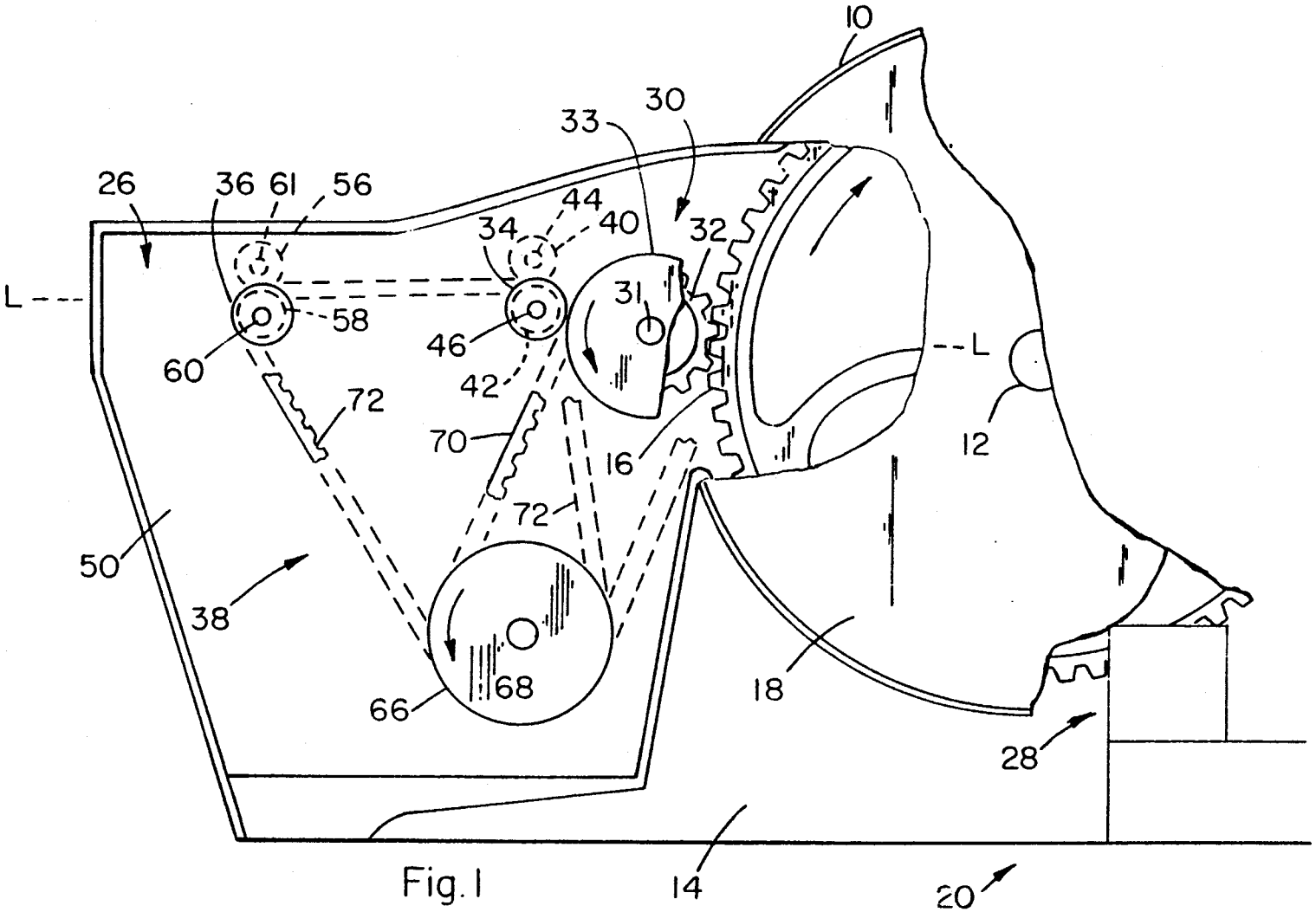
FIG. 1 is an elevational side view of the front end portion of a card with the drive mechanism of the invention shown in place partially in section.

Referring to the drawings, the doffer cylinder means 10, hereinafter doffer, is rotatably mounted by shaft 12 to the frame of the card, generally designated 14, and is provided with a ring gearing 16, connoted gear means herein, which is substantially shrouded by cap 18, all in conventional manner.

In accordance with the present invention and with reference to the claims hereof, the present fiber processing system for the front end 20 of a card comprises doffer cylinder means 10, crush-roll means 22 and calendar roll means 24 rotatively mounted in progression respectively from back to front on the front end 26 of frame means 14 of the textile card, gearing means 16 on said doffer cylinder means, timing unit means generally designated 30 rotatably mounted on said frame means and having toothed timing pulley 33 and gear means 32 engaging said gear means 16 on said doffer cylinder means for being driven thereby or for driving the same, driven timing pulley means generally designated 34 and 36 respectively on said crush-roll means and calendar-roll means, and timing belt means generally designated 38 connecting said timing pulley means 30 to each of said driven timing pulley means 34 and 36 of said crush-roll and calendar-roll means respectively for rotating the same at speeds proportional to the speed of rotation of said doffer cylinder means. In the embodiment of the present invention shown in FIGS. 3 and 4, pulley means 34 is a compound pulley comprising double timing pulleys 35 and 37 which affords a more compact and simplified version of the drive and driven mechanism.

The timing pulley means 30, as a unit, is either locked onto shaft 31 which is rotatably mounted on frame 14, or is itself rotatable on shaft 31 which would be non-rotatably secured to said frame. The timing pulleys 35, 36 and 37 are, of course, locked onto their respective shafts for rotating the same and the roll means integral therewith.

It is within the purview of the present invention to employ either of the gear means 16 or 32, or the dual pulley 66 hereinafter described, as the driving means for the present fiber processing system. In doing so, a motor 28 may be provided to drive the doffer ring gear 16, or such motor may conveniently be, for example, connected to the opposite end of either shaft 68 of the said dual pulley or shaft 31 of pulley means 30 in known manner. The preferred types of timing pulley and belt are shown and described on page 9 of the Industrial Belt Installation and Maintenance Manual of Bando American, Inc., 1149 W. Byrn Mawr, Itasca, Ill., catalog BA 106/3-88, and marketed respectively under the tradenames QD, and Synchro-Link TM.

The crush-roll means typically comprises upper roll 40 and lower roll 42, the shafts 44, 46 respectively thereof being mounted for rotation in the sides 48, 50 of the frame front end. In order to power both rolls, lower shaft 46 is provided at one end with a driven timing pulley 34, and the upper and lower rolls are provided at their other ends with meshing gears 52, 54 respectively. The calendar-roll means is similarly constructed with the upper and lower rolls 56, 58 affixed to shafts 59, 60 respectively, driven timing pulley 36 affixed to lower roll shaft 60 and upper and lower meshing gears 62 and 64 respectively.

A typical and useful tooth combination for the above components are as follows:

Doffer ring gear, 16, dia. about 40 in., 240 teeth;
Doffer cylinder, 10, dia. about 60 in.;
Gear, 32, dia. about 10 in., 48 teeth;
Pulley 33 dia. about 10 in., 48 teeth;
Crush-roll Pulley 34 dia. about 5 in., 21 teeth;
Crush-rolls 40, 42 dia. about 3 in.;
Calendar-roll pulley 36 dia. about 4 in., 18 teeth;
Calendar-rolls 56, 58 dia. about 1.5 in.

It is preferred that some form of take-off mechanism, e.g., air jet, comb, mechanical, or other such device be provided to precisely strip fiber from the doffer. Such a device which may be employed herein comprises take-off roll 65 as shown in the drawings, such a device being shown for example, as element 15 in U.S. Pat. No. 4,027,358 or as element 32 in U.S. Pat. No. 4,813,104, the disclosures of which are incorporated herein by reference. The take-off roll may be conveniently driven by gear 67 mounted on the take-off roll shaft 69 and meshing with idler gear 71 rotatable on shaft 73 fixed to frame side 48 and which is driven by lower gear 54. It is noted, that additional roll means such as the redirecting roll "*6a*" of U.S. Pat. No. 3,965,401 may also be employed in the present device. In this regard, such additional components, while desireable in practising the present invention, are not necessary and thus are not present as claim limitations.

Figure 2:
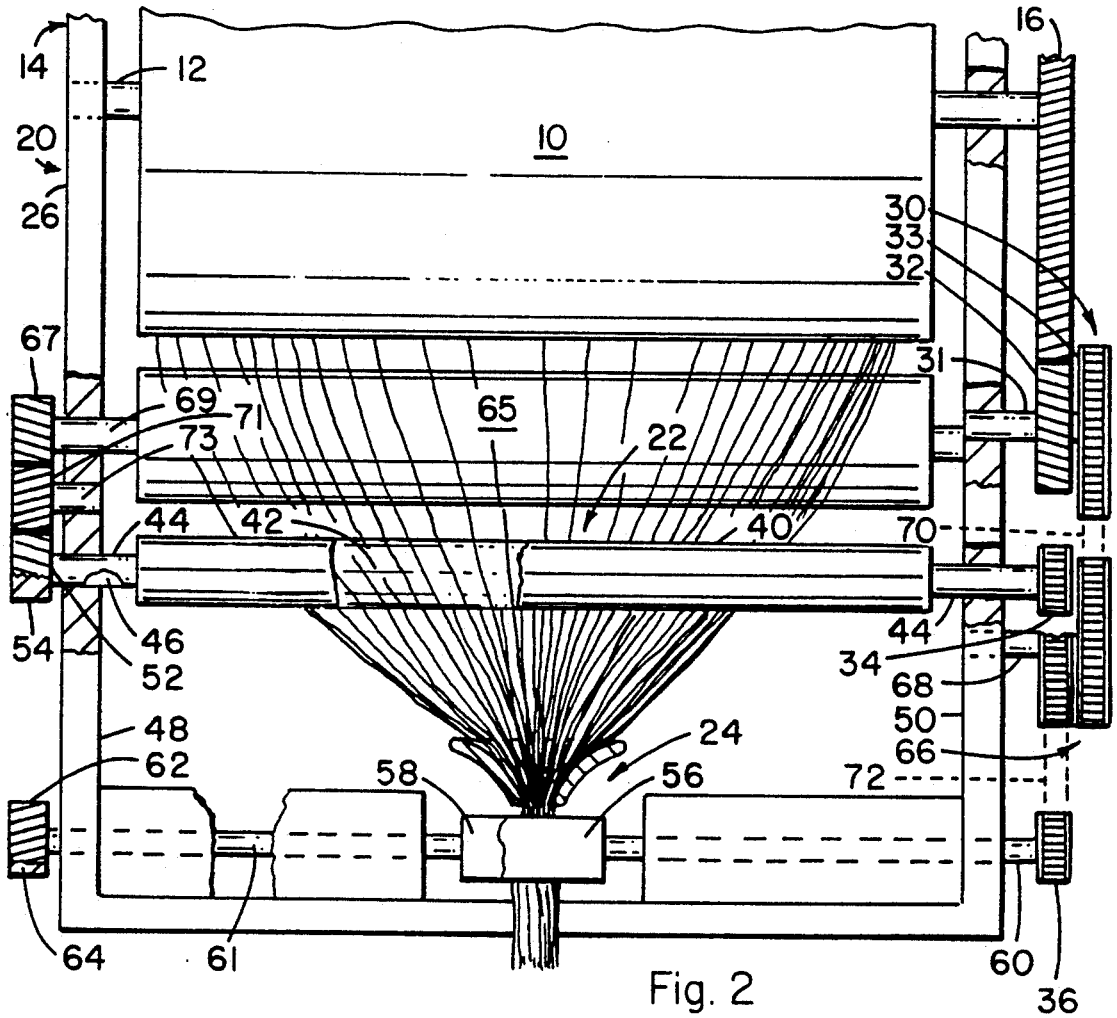
FIG. 2 is a top elevational view with portions shown in section, of the front end of the card of FIG. 1.
Figure 5:
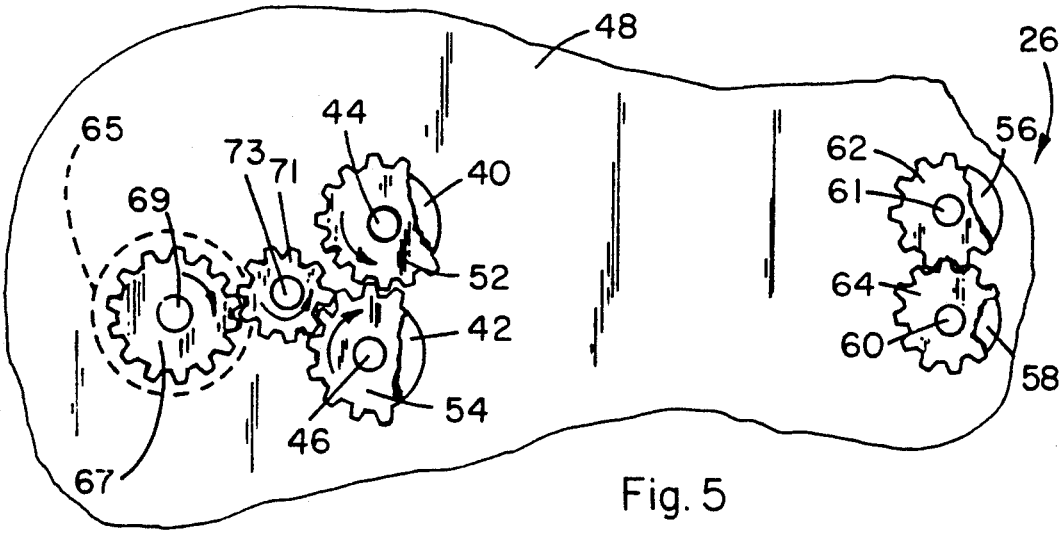
FIG. 5 is a left hand side view of FIG. 2 showing the gearing for driving the roll pairs in tandem.

For the pulley arrangement of FIGS. 1 and 2, a dual timing idler pulley 66 be provided and mounted on shaft 68 rotatably journaled in side 50 of the frame. With such an arrangement the existing structure of conventional cards may be employed and the proper tension of the timing belt means can readily be achieved. In this regard, the rotational axes of roll shafts 46, 60 and shaft 31 of the timing drive pulley means 30 lie substantially along a line segment L—L, and the axis of shaft 68 is substantially vertexly oriented thereto, i.e., substantially forms an equilateral-like triangle therewith and thus enhances uniform rotational motion of the roll pairs through timing belts 70 and 72.

Figure 3:
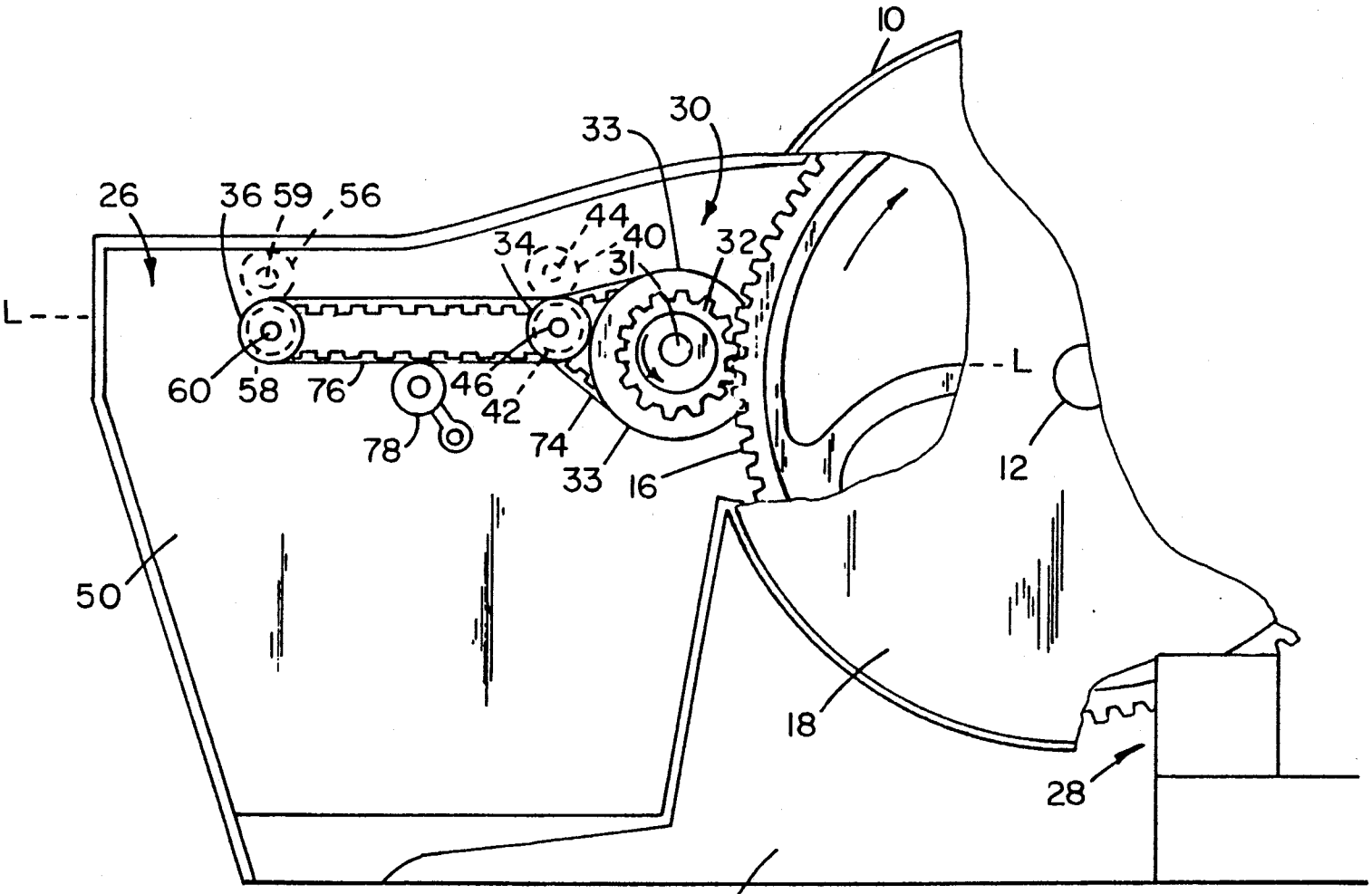
FIG. 3 is a view as in FIG. 1 showing a variation of the present drive mechanism.
Figure 4:
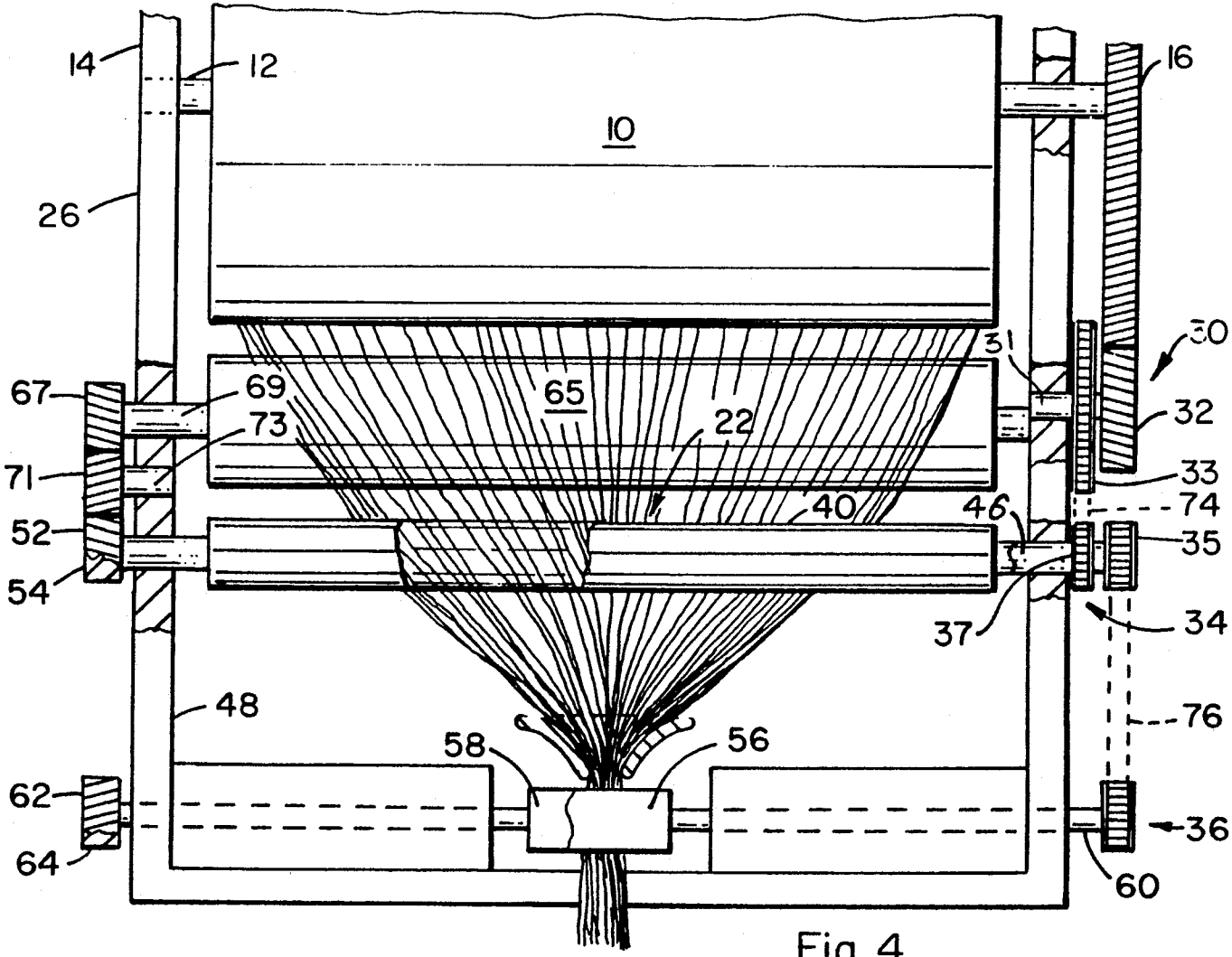
FIG. 4 is a view as in FIG. 2 showing the variation of drive mechanisms of FIG. 3.

In the embodiment of FIGS. 3 and 4, the timing belt means 38 comprises belts 74 and 76, and a belt tensioner roller 78 may be provided in known manner as needed. This embodiment is most preferred and affords easy belt and pulley alignment and thus greater belt and shaft bearing life.

With these pulley arrangements, the doffer can be effectively run, e.g., at speeds of about 50 rpm to process up to about 105 pounds/hr of fiber to produce sliver of about 70 grains. This represents a major achievement in textile carding operations.

The invention has been described in detail with particular reference to preferred embodiments thereof, but it will be understood that variations and modifications will be effected within the spirit and scope of the invention.

We claim:

1. A fiber processing system for the front end of a textile card, comprising a doffer cylinder, a crush-roll pair and a calendar-roll, pair rotatively mounted in progression respectively from back to front on the front end of frame means of the textile card, a gearing means on said doffer cylinder, a timing unit having a timing drive pulley and timing gear combination rotatably mounted on said frame means for tandem rotation, said timing gear of said timing unit engaging said gearing means on said doffer cylinder, drive means including speed reduction means for directly driving said doffer cylinder, a timing slave pulley on one end of one roll of each of said crush-roll pair and calendar-roll pair, at least one timing belt connecting said timing drive pulley to each of said timing slave pulleys of said crush-roll pair and calendar-roll pair for rotating each said pair at speeds proportional to the speed of rotation of said doffer cylinder, and meshing gear means on the opposite end of each said one roll and on the adjacent end of each other roll of each said pair for causing the two rolls of each said pair to rotate in tandem.

2. The system of claim 1 wherein said timing unit incoporates a separate dual timing pulley mounted on said frame means, and the driven slave pulleys of said crush-roll and calendar-roll pairs are connected to the same pulley of said dual timing pulley.

3. The system of claim 2 wherein the rotational axis of each slave pulley of said crush-roll and calendar-roll pairs of said timing drive pulley and gear of said timing unit are substantially on a line segment, and the rotational axis of said dual timing pulley is translated downwardly from said line segment to outline a triangle, the apices of which comprise said rotational axis of each of said timing drive pulley, said calendar-roll pair and said dual timing pulley.

4. The system of claim 1 wherein the diameter of each of said gearing means, timing gear, gear means and pulley means is dimensioned to provide substantially equal surface speeds of said doffer cylinder and said crush-roll pair, and to provide a surface speed of said calendar-roll pair which is up to about 40% faster than the surface speed of said crush-roll pair.

5. The system of claim 1 wherein the timing slave pulley of said crush-roll pair comprises dual timing pulleys, one of which drives the timing slave pulley of said calendar-roll pair.

6. The system of claim 5 wherein the rotational axis of the timing slave pulley of each of said crush-roll pair and of said calendar-roll pair, and of said timing unit are substantially in alignment.

* * * * *